US006065386A

United States Patent [19]

Rüb et al.

[11] Patent Number: 6,065,386

[45] Date of Patent: May 23, 2000

[54] HYDRAULIC DEVICE FOR CONTROLLING A HYDRAULIC-FLUID FLOW

[75] Inventors: Winfried Rüb, Neustadt/Main; Heinz Schulte, Marktheidenfeld, both of Germany

[73] Assignee: Mannesmann Rexroth AG, Lohr/Main, Germany

[21] Appl. No.: 09/101,581

[22] PCT Filed: Dec. 21, 1996

[86] PCT No.: PCT/DE96/02504

§ 371 Date: Jul. 10, 1998

§ 102(e) Date: Jul. 10, 1998

[87] PCT Pub. No.: WO97/28373

PCT Pub. Date: Aug. 7, 1997

[30] Foreign Application Priority Data

Jan. 30, 1996 [DE] Germany ..... 196 03 210

[51] Int. Cl.[7] ..... F15B 13/04

[52] U.S. Cl. ..... 91/31; 91/446; 60/494

[58] Field of Search ..... 91/31, 446, 443, 91/454; 60/494

[56] References Cited

U.S. PATENT DOCUMENTS

| | | | |
|---|---|---|---|
| 3,439,709 | 4/1969 | Schott et al. . | |
| 3,999,386 | 12/1976 | Crull et al. | 60/494 |
| 4,401,009 | 8/1983 | Zeuner et al. | 91/446 |
| 5,072,648 | 12/1991 | Krahn et al. | 91/454 |
| 5,088,283 | 2/1992 | Bosniac | 60/494 |

FOREIGN PATENT DOCUMENTS

| | | | |
|---|---|---|---|
| 0546300 | 6/1993 | European Pat. Off. . | |
| 2826613 | 12/1979 | Germany . | |
| 3434014 | 3/1986 | Germany . | |
| 3938560 | 5/1991 | Germany . | |
| 4030952 | 4/1992 | Germany . | |
| 4107776 | 9/1992 | Germany . | |
| 4423644 | 1/1996 | Germany . | |
| 4431951 | 3/1996 | Germany . | |
| 1479717 | 5/1989 | Russian Federation | 91/443 |

OTHER PUBLICATIONS

Olhydraulik Und Pneumatic, vol. 37, No. 8, Aug. 1, 1993, pp. 618–621, XP000413160, "Grundlagen Der Hydraulischen Schaltungstechnik".

Olhydraulik Und Pneumatic, vol. 37, No. 9, Jan. 1, 1993, pp. 677, 678, 680–681, XP000195240, "Grundlagen Der Hydraulischen schaltungstechnik".

*Primary Examiner*—F. Daniel Lopez
*Attorney, Agent, or Firm*—Martin A. Farber

[57] ABSTRACT

The invention concerns a hydraulic device for controlling the hydraulic-fluid flow to and from a single-acting cylinder (3) on which a load (4) acts. Located between a pump (1) and the cylinder (3) is a controlled valve array (5) which, together with a controlled on-off valve (9) which in one position allows hydraulic fluid to pass back into the reservoir (2), controls the flow of hydraulic fluid to and from the cylinder (3). In order to be able to lift the piston slowly and at constant speed in the cylinder (3), independently of the load (4) acting on the piston, the invention calls for a throttle (6) and a non-return valve (7) to be connected in series, by-passing the valve array (5). A pressure regulator (10) maintains the pressure difference through the throttle (6) constant and feeds the fluid not required to maintain the pressure difference through the throttle (6) back to the reservoir (2). When the load (4) is lifted slowly, the valve array (5) is switched into a position in which the flow of hydraulic fluid to the cylinder (3) is blocked, and the cut-off valve (9) blocks the connection between the throttle (6) and the reservoir (2). The invention is particularly suitable for use in controlling the lifting gear of a mobile machine such as a stacker truck or an agncultural machine.

8 Claims, 3 Drawing Sheets

HYDRAULIC DEVICE FOR CONTROLLING A HYDRAULIC-FLUID FLOW

FIELD AND BACKGROUND OF THE INVENTION

The invention relates to a hydraulic device for controlling the pressure medium flow to and/or from a single-acting cylinder subjected to a load, with a pump that delivers the pressure medium from a tank to the single-acting cylinder, with a valve array located between the pump and the single-acting cylinder, said array, together with a switching valve that returns the pressure medium to the tank in one switch position, controlling the pressure medium flow to and/or from the single-acting cylinder, especially for controlling the lifting mechanism of a mobile machine.

A device of this kind for controlling the pressure medium flow to and/or from a single-acting cylinder subjected to a load is known from DE 40 30 952 Al. No details of the load that is applied to the single-acting cylinder are provided in this patent. An electrically actuated shutoff valve is located between a fixed displacement pump and a singe-acting cylinder. This shutoff valve forms a valve array with two connections that operates as a check valve in one flow direction of the pressure medium and allows a continuous fine control of the pressure medium flow in the other flow direction. The shutoff valve and an additional switching valve that is likewise electrically actuated control the pressure medium flow to and/or from the cylinder. A switching valve in a first switch position connects the fixed displacement pump with the shutoff valve. In the other switch position of the switching valve, it connects the fixed displacement pump with the tank as well. In the first switch position of the switching valve, pressure medium flows from the fixed displacement pump through the valve array which acts as a check valve in this flow direction. The connection from the fixed displacement pump to the tank is thus blocked. The piston of the cylinder is extended at maximum speed, corresponding to the volume flow of the fixed displacement pump and the dimensions of the cylinder, and the load to which the cylinder is subjected is raised. In the second switch position of the switching valve, pressure medium supplied by the fixed displacement pump flows back directly to the tank. As the load falls, pressure medium forced out of the cylinder is also returned to the tank. If the shutoff valve is not actuated, the shutoff valve closes. Then no pressure medium flows out of the cylinder and the load is held. If the shutoff valve and the switching valve are both actuated, pressure medium flows out of the cylinder through the shutoff valve and the switching valve to the tank. Fine control of the pressure medium flow returning to the tank through the shutoff valve is provided by the level of the electrical control signal supplied to the shutoff valve. When lifting the load, in contrast to lowering of the load, it is not possible to control the speed.

To control the lifting mechanism of a mobile machine, for example the lifting mechanism of a forklift or an agricultural machine, constantly operating proportional valves are generally employed to which pressure medium is supplied by a fixed displacement pump. These valves permit a continuous change in the speed at which the lifting mechanism is raised or lowered. It has been found in practice that in many instances, for example in plows or the cutters of combines, a continuous change in the adjustment rate of the lifting mechanism is not necessary, but two different speeds for raising and lowering are sufficient for adjusting the lifting mechanism, a first speed with which considerable positioning travel can be rapidly achieved and a second speed slower than the first speed for slowly lifting and lowering the tool mounted on the lifting mechanism for fine positioning, for example when coupling to the lifting mechanism or uncoupling from the lifting mechanism. A control of this kind can be provided more economically with switching valves than with proportional valves. The device operates at the fast speed until it comes into the vicinity of the desired position and then a fine positioning is performed at the slow speed. The fixed displacement pump is designed so that it delivers the pressure medium flow required for rapidly lifting the load. When the load is lifted rapidly, the pressure medium flow supplied to the single-acting cylinder (consumer flow) is equal to the pressure medium flow (pump flow) delivered by the fixed displacement pump. When lifting the load slowly, the consumer flow is smaller than the pump flow in accordance with the lower adjusting speed. The reduction in the consumer flow required for lifting the load slowly is provided by a suitably dimensioned throttle in the valve array located between the pump and the consumer. The difference between the pump flow and the consumer flow in the simplest case is returned through a pressure-limiting valve to the tank. The pump pressure rises until it reaches the limiting pressure of the pressure-limiting valve. Since the pressure-limiting valve serves primarily as a safety valve, the limiting pressure that is set is higher than the maximum load pressure that develops during operation. The pump pressure thus rises to a greater value when lifting slowly than when lifting rapidly, when the pump pressure is only slightly above the load pressure. The consumer flow during slow lifting is determined by the cross-sectional area of the throttle and the pressure drop at the throttle. The pressure drop at the throttle is equal to the difference between the limiting pressure of the pressure-limiting valve and the load pressure. Since the limiting pressure of the pressure-limiting valve, once set, remains constant, the consumer flow depends only on the size of the load. As the load pressure rises, the pressure differential between the limiting pressure and the load pressure falls and the consumer flow decreases with the root of the pressure differential. This means that when lifting slowly, small loads are raised more rapidly than large loads.

SUMMARY OF THE INVENTION

It is an object of the invention is to provide a device of the introductorily mentioned type that allows the load to be lifted slowly and in which the piston of the single-acting cylinder, when lifting slowly, is extended at a constant speed regardless of the load to which the piston is subjected.

According to the invention the pump flow that bypasses the valve array is divided upstream of the throttle into two partial flows of which the smaller flows as a constant pressure medium flow through the throttle and the larger one that results from the difference between the pump flow and the constant pressure medium flow flows back through the pressure-compensating valve to the tank. The pressure-compensating valve keeps the pressure differential across the throttle, and hence the pressure medium flow flowing through the throttle, constant. In one switch position of the switching valve, this pressure medium flow is supplied to the single-acting cylinder, and the piston of the single-acting cylinder lifts the load slowly. In the other switch position of the switching valve, the constant pressure medium flow flowing through the throttle is fed to the tank. Since only the smaller partial flow flows through the switching valve, the switching valve is required to be dimensioned only for this partial flow and not for the combination of the pump flow and the consumer flow that is squeezed out of the chamber of the single-acting cylinder when the load is lowered rapidly. Therefore, a switching valve of a smaller size can be used. The pump pressure is adjusted as a function of the pressure drop across the throttle.

Advantageous improvements of the invention are as follows. A blocking position of the valve array makes it possible to bypass the valve array when lifting the load slowly. By using another throttle in series with the first throttle, the pressure drop at the series connection of the first throttle and the check valve that bypasses the switching valve array can be increased if necessary. Feedback from the additional throttle that affects the function of the pressure-compensating valve can be avoided if the cross-sectional area of the additional throttle is equal to the cross-sectional area of the first throttle or is larger than the latter. Because of the location of the pressure-limiting valve between the first throttle and the switching valve, the pressure-limiting valve as well as the switching valve need be dimensioned only for the pressure medium flow flowing through the throttle. Here again, the larger partial flow flows through the pressure-compensating valve to the tank. When the pressure-limiting valve is located between the check valve and an additional throttle that is located in a line that branches off from the connection between the switching valve array and the cylinder, in addition to the limitation of the output pressure of the pump there is also a limitation of the load pressure.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Parts that are the same have been given the same reference numbers in the Figures.

Figure 1:
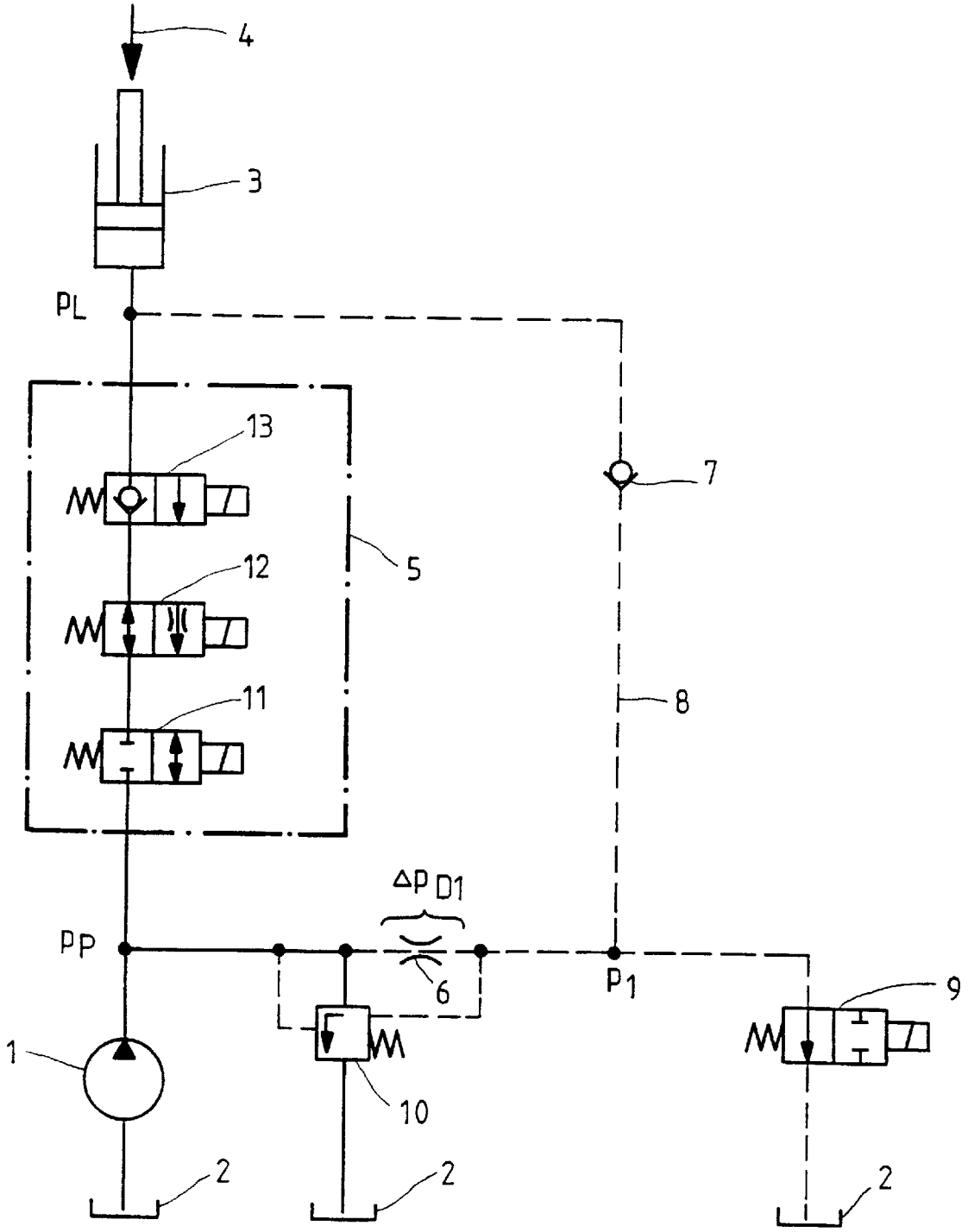
FIG. 1 shows a first hydraulic device according to the invention in a schematic representation.
Figure 2:
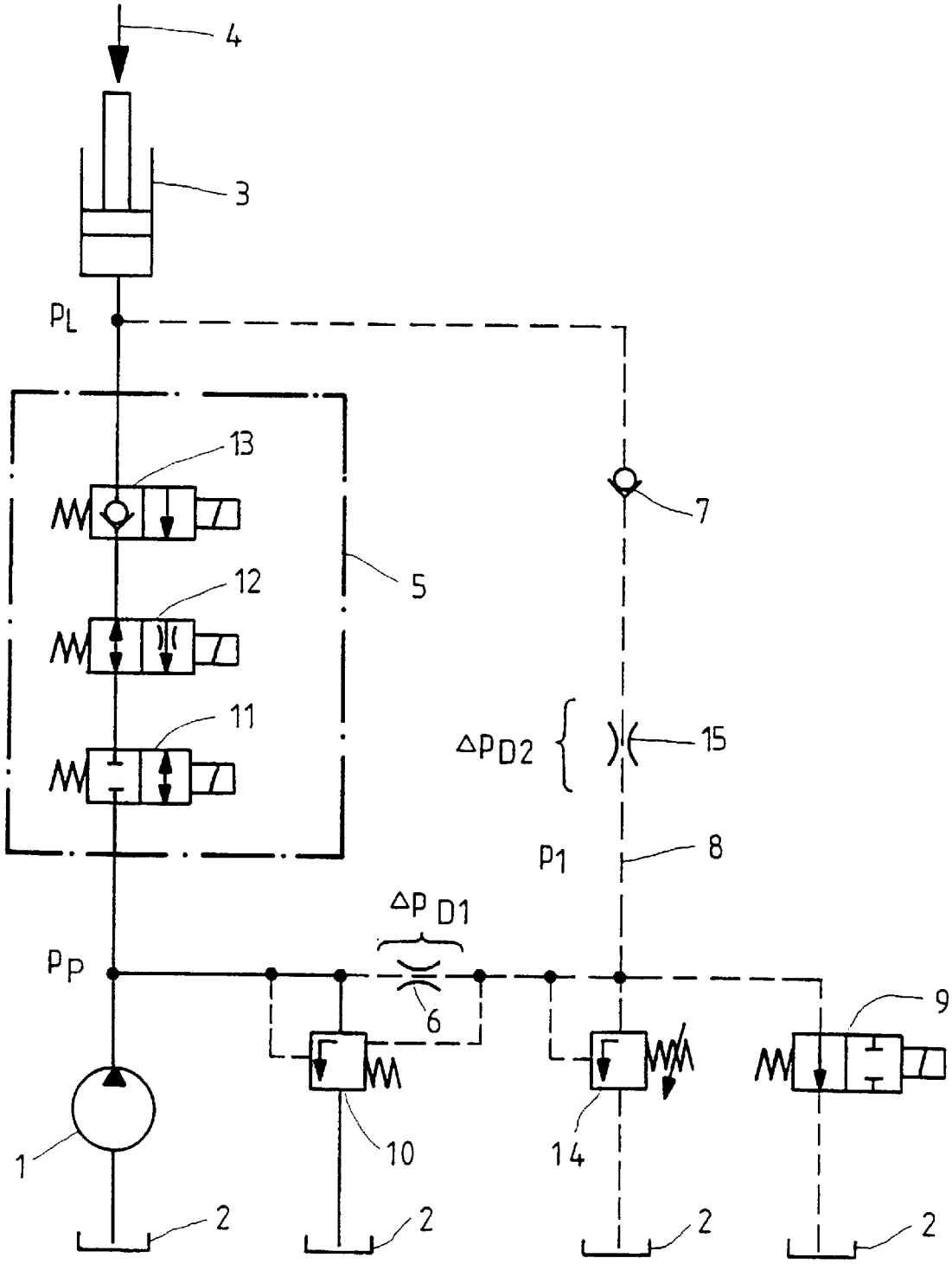
FIG. 2 shows a second hydraulic device according to the invention in a schematic representation.
Figure 3:
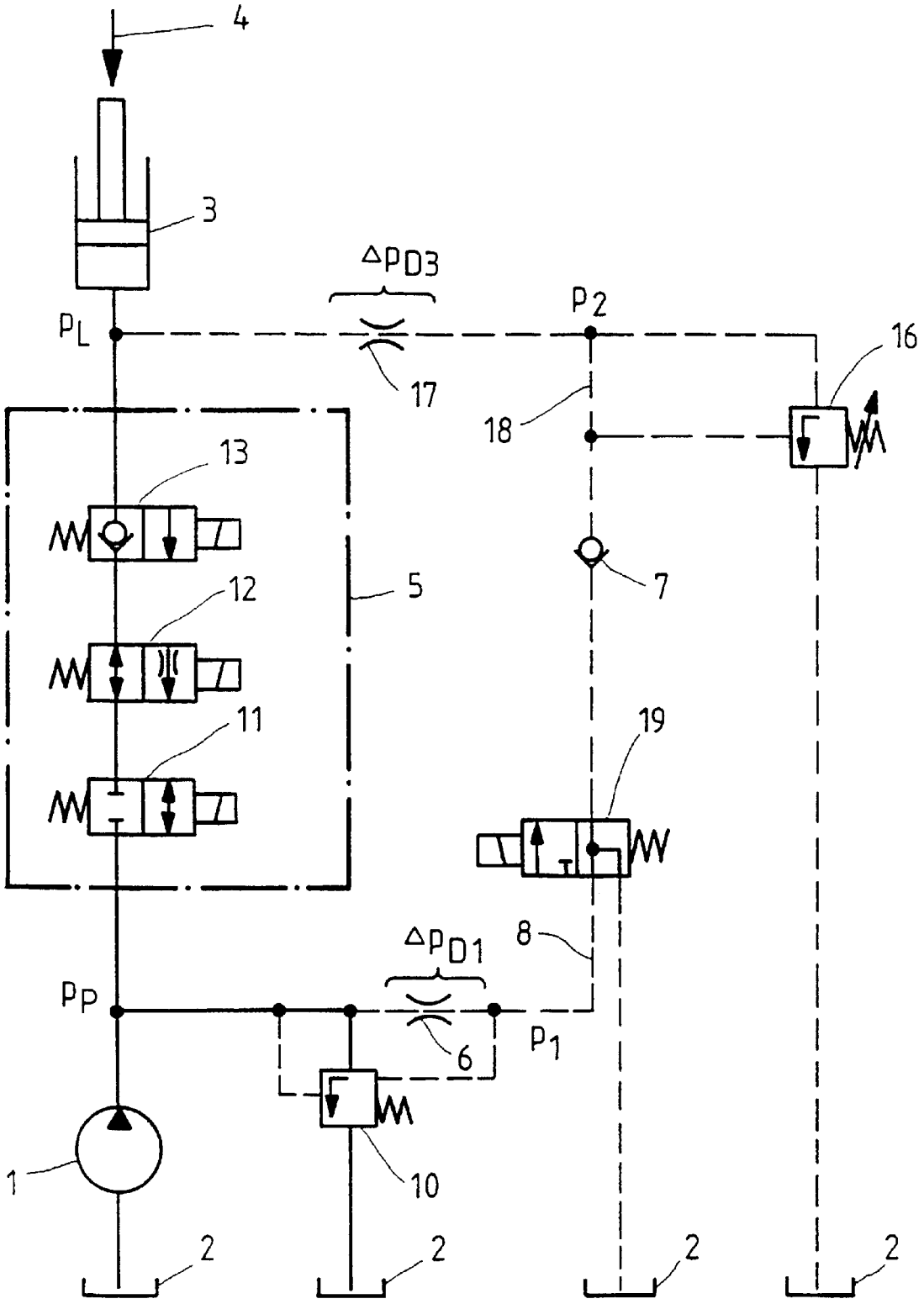
FIG. 3 shows a third hydraulic device according to the invention in a schematic representation.

In a hydraulic device shown in FIG. 1, a pump 1 delivers pressure medium from a tank 2 to a single-acting cylinder 3 subjected to a load 4. The load 4 is represented in FIGS. 1 to 3 as an arrow that shows the direction of action of the load 4. The pump 1 is a fixed displacement pump. The pressure medium flow delivered by it, the pump flow, is constant. The pump flow is chosen in accordance with the consumer flow required for lifting the load 4 rapidly. Between the pump 1 and the cylinder 3, an electrically actuated valve array 5 is located. The series connection composed of a throttle 6 and a check valve 7 is located in parallel with this valve array. A line 8 connects the throttle 6 with the check valve 7. Between the line 8 and the tank 2 an electrically actuated switching valve 9 is located which in the resting position shown connects the line 8 with the tank 2 and in its working position, interrupts the connection between the line 8 and the tank 2. A pressure-compensating valve 10 keeps the pressure differential across the throttle 6 constant. The pressure differential across the throttle 6 is represented below by $\Delta P_{D1}$. Thus a constant pressure medium flow flows through throttle 6, with the value of this flow being determined by the cross-sectional area of throttle 6 and the pressure differential $\Delta P_{D1}$ across the throttle 6. The constant pressure medium flow flowing through the throttle 6 is referred to below as the throttle flow. Its value is chosen in accordance with the speed desired for slowly lifting the load 4. The pressure medium flow that is not required to maintain the pressure differential $\Delta P_{D1}$ across the throttle 6, in other words the difference between the pump flow and the throttle flow, is conducted away directly to tank 2 through the pressure-compensating valve 10. The pressure-compensating valve 10 together with the throttle 6 forms a three-way flow-regulating valve. In the following, the pump pressure is represented by $P_P$, the pressure in the line 8 by $P_1$ and the load pressure of the single-acting cylinder 3 by $P_L$. For the pressure $P_1$ in the line 8, therefore, $P_1=P_P-\Delta P_{D1}$. In the embodiment under discussion here, the pressure differential $\Delta P_{D1}$ is approximately 3 bars and is therefore much smaller than the load pressure $P_L$ that is on the order of 100 bars.

The electrically actuated valve array 5 together with the electrically actuated switching valve 9 controls the flow of pressure medium from the pump 1 to the cylinder 3 and from the cylinder 3 to the tank 2. The valve array 5 has two pressure medium connections of which one is connected with the pump 1 and the other with the cylinder 3. When not actuated electrically, the valve array 5 is blocked in both flow directions. For the flow direction of the pressure medium from the cylinder 3 to the tank 2, the valve array 5 behaves like a check valve subjected to a load in the blocking direction. To lift the load, the valve array 5 is controlled so that the entire pump flow flows into cylinder 3. The valve array 5 then behaves like a check valve that is subjected to a load in the flow direction. To lower the load, the valve array 5 and the switching valve 9 are controlled so that the pressure medium can flow from the cylinder 3 to the tank 2. By throttling the throughput cross section of the valve array 5 the sinking rate of load 4 can be reduced. The hardware design of valve array 5 is then of secondary importance.

As an example of the design of such a valve array, the valve array 5 is shown in the figures as a series connection of three electrically actuated switching valves 11, 12, and 13. When switching valve 11 is actuated, it allows a pressure medium flow in both flow directions. In the resting position shown in the figures, it blocks in both flow directions. Blockage that is free of leaks, however, is not necessary. The switching valve 12 in the resting position shown in the figures allows a pressure medium flow in both flow directions. In its working position, it throttles the throughput cross section for the pressure medium flowing back to tank 2. Switching valve 13 shown in the figures in its resting position is a check valve that prevents a backflow of pressure medium from cylinder 3 in its resting position. In its working position, switching valve 13 allows an unthrottled backward flow of pressure medium from the cylinder 3. No provision is made for a throttled medium pressure flow from the pump 1 through the valve array 5 to the cylinder 3.

The switching valves 9 and 11 to 13 are initially not actuated but are in the resting position shown in FIG. 1. In the resting position of switching valve 9, the output of the pump 1 is connected through throttle 6 with the tank 2. In this position of the switching valves 9 and 11 to 13, the pump flow flows as partial flows back to the tank 2. The larger partial flow flows through the pressure-compensating valve 10 directly to tank 2 while the smaller throttle flow flows through the switching valve 9 to the tank 2. The pump pressure $P_P$ is adjusted so that it is equal to the pressure differential $\Delta P_{D1}$ across the throttle 6. Because of the low pump pressure $P_P$, only a small power loss occurs in this position of switching valves 9 and 11 to 13. In this position of switching valves 9 and 11 to 13, the load is held, i.e. pressure medium does not flow into the cylinder 3 nor does it flow back from the latter. The check valve 7 prevents the pressure medium from flowing from the cylinder 3 through the line 8 to the tank 2.

In order to lift the load 4 rapidly, the switching valves 9 and 11 are switched to the working position, while switching valves 12 and 13 remain in the resting position. Thus the connection between the line 8 and the tank 2 is broken and the entire pump flow flows as a consumer flow to the single-acting cylinder 3. The pump pressure $P_P$ is set so that it is larger than the load pressure $P_L$ by the pressure drop at valve array 5.

In order to lift load 4 slowly at a constant speed that is independent of the value of load pressure $P_L$, only switching valve 9 is switched to the working position. Since valve array 5 and switching valve 9 are blocked, the pressure medium delivered by pump 2 flows through the throttle 6, the line 8, and the check valve 7 to the single-acting cylinder 3. The consumer flow is now equal to the throttle flow. If one neglects the pressure drop at the check valve 7, the pressure $P_1$ in the line 8 is equal to the load pressure $P_L$ and the pump pressure $P_P$ is then equal to $P_L+\Delta P_{D1}$. The difference between the pump flow and the throttle flow flows through the pressure-compensating valve 10 to the tank 2. Since the throttle flow is independent of the value of the load pressure $P_L$, the load 4 is always raised at the same constant speed during slow lifting.

In order to lower the load 4 rapidly, the switching valves 11 and 13 are switched to the working position, while the switching valves 9 and 12 remain in the resting position. The pressure medium forced out of the single-acting cylinder 3 initially flows through the valve array 5 and then together with a pump flow to tank 2. The total flow of pressure medium then divides into two partial flows. The constant throttle flow flows to the tank 2 through the throttle 6 and the switching valve 9, while the remaining pressure medium flow flows directly through the pressure-compensating valve 10 to the tank 2. The pump pressure $P_P$ is adjusted so that it is equal to the pressure differential $\Delta P_{D1}$ at the throttle 6. Since only a small constant partial flow flows thorough the switching valve 9 to the tank 2, an economical valve of a small size may be used.

In order to lower the load 4 slowly, the switching valves 11, 12, and 13 are switched to the working position, while the switching valve 9 remains in the resting position. Because of the throttle that is operative in the working position of the switching valve 12, only a consumer flow flows that is reduced relative to the pressure medium flow that flows when the load is lowered rapidly, said consumer flow flowing together with the pump flow to the tank 2. The total flow is again divided into two partial flows. The constant throttle flow flows to the tank 2 through the throttle 6 and the switching valve 9 while the remaining pressure medium flow flows directly through the pressure-compensating valve 10 to the tank 2. The pump pressure $P_P$ is adjusted so that it is equal to the pressure differential $\Delta P_{D1}$ at the throttle 6.

The switching valves 11 to 13 that are shown as 2/2-way valves with two active connections and two switch positions, serve only to explain the function of the valve array 5. The valve array 5 can also be formed differently. For example, the switching valves 12 and 13 can be replaced by the shutoff valve that is known from DE 40 30 952 A1. It is also possible to replace the valve array 5 by a single valve that has several functions. The only important thing is that the valve array 5, in a first switch position and/or combination of switch positions blocks the flow of pressure medium from the pump 1 to the cylinder 3, and in a second switch position and/or combination of switch positions permits a check valve function for rapidly lifting the load 4, and in a third switch position and/or combination of switch positions, allows a rapid lowering of the load 4, and in a fourth switch position and/or combination of switch positions, constitutes a throttle for slowly lowering the load.

In addition, in the hydraulic device shown in FIG. 2 the hydraulic device shown in FIG. 1 also includes a pressure-limiting valve 14 and an additional throttle 15.

The pressure-limiting valve 14 is located between the throttle 6 and the switching valve 9. It limits the pressure $P_1$ both during rapid lifting and during slow lifting of the load 4 and thus also limits the pump pressure $P_P$ that is greater by the constant pressure differential $\Delta P_{D1}$ when the load 4 for example strikes a stop and the single-acting cylinder 3 cannot accept any more pressure medium. Since, when the pressure-limiting valve 14 responds, only a portion of the pump flow is flowing through the pressure-limiting valve 14 while the greater partial flow is already being carried away through the pressure-compensating valve 10 to tank 2, a valve with a smaller size can be used as the pressure-limiting valve 14, as in the case of the switching valve 9.

With the switching valve 9 blocked and the valve array 5 blocked, the same pressure medium flow flows through the throttle 15 as through the throttle 6. Advantageously the cross-sectional area of the throttle 15 is equal to the cross-sectional area of the throttle 6 or is larger than the latter. The pressure differential designated $\Delta PD_2$ is then equal to or smaller than the pressure differential $\Delta P_{D1}$ across the throttle 6. By using the throttle 15, when the switching valve 9 is in the working position, a greater pressure drop across the valve array 5 can be achieved without increasing the pump pressure $P_P$ in the resting position of the switching valve 9 to the same extent.

The hydraulic device shown in FIG. 3, in addition to the hydraulic device shown in FIG. 1, contains a pressure-limiting valve 16 and an additional throttle 17. A line 18 connects the check valve 7 with the throttle 17. The pressure in the line 18 is marked $P_2$. It is limited to an adjustable value by the pressure-limiting valve 16, said value being greater than the largest load pressure $P_L$ that occurs during operation. The pressure differential across the throttle 17 is designated $\Delta P_{D3}$. A switching valve 19 is inserted between the throttle 6 and the check valve 7 in the line 8. The switching valve 19 is an electrically actuated switching valve with three active connections and two switch positions. Since it has the same function as the switching valve 9 in FIGS. 1 and 2, it can replace the switching valve 9 in FIGS. 1 and 2. Likewise, the switching valve 9 shown in FIGS. 1 and 2 can be used in FIG. 3 instead of the switching valve 19. The switching valve 19 in the resting position connects line 8 with the tank 2 and in the working position blocks the connection between the line 8 and the tank 2.

The pressure-limiting valve 16 limits the load pressure $P_L$, in other words the pressure in the piston chamber of cylinder 3 when, while holding load 4, the pressure medium in the piston chamber expands for example because of solar irradiation, or if additional forces act on the piston of the cylinder 3 under the influence of a body that falls on the raised lifting mechanism.

If the piston of the cylinder 3 encounters a stop as it is rising slowly or rapidly, the pressure-limiting valve 16 limits the pump pressure $P_P$ to a value that is larger by $\Delta P_{D1}$ than the response pressure of the pressure-limiting valve 16. In this case also, at most the throttle flow limited by the pressure-compensating valve 10 flows through the throttle 6 as a control flow while the remaining pressure medium flow flows through the pressure-compensating valve 10 directly to the tank 2. The pressure-limiting valve 16 therefore need only be dimensioned for the pressure medium flow flowing through the throttle 6.

We claim:

1. Hydraulic device for controlling the pressure medium flow to and/or from a single-acting cylinder subjected to the influence of a load, with a pump that delivers pressure medium from a tank to the single-acting cylinder, and with a controlled valve array located between the pump and the single-acting cylinder, whereby said array, together with a controlled switching valve that returns pressure medium to the tank in one switch position, controls the pressure medium flow to and/or from the single-acting cylinder, characterized in that a series connection composed of a throttle (6) and a check valve (7) that prevents the reverse flow from single-acting cylinder (3) is located between the pump (1) and the single-acting cylinder (3) and bypasses the valve array (5), in that the switching valve (9; 19) in one position connects the line (8) between the throttle (6) and the check valve (7) with the tank (2) and in the other position interrupts the connection to the tank (2) and in that a pressure-compensating valve (10) keeps the pressure differential ($\Delta P_{D1}$) across the throttle (6) constant and carries away the pressure medium volume that is not required to maintain the pressure differential ($\Delta P_{D1}$) across the throttle (6).

2. Device according to claim 1, characterized in that the valve array (5) is switched into a position that blocks the pressure medium flow into the single-acting cylinder (3) for lifting load (4) slowly and that, at the same time, the switching valve (9; 19) blocks the connection between the throttle (6) and the tank (2).

3. Device according to claim 1, characterized in that an additional throttle (15, 17) is connected in series with the first throttle (6) between the first throttle (6) and the connection of the valve array (5) on the cylinder side.

4. Device according to claim 3, characterized in that the cross-sectional area of the additional throttle (15; 17) is equal to or greater than the cross-sectional area of the first throttle (6).

5. Device according to claim 3, characterized in that the additional throttle (15) is located between the first throttle (6) and the check valve (7) and that the connection of the switching valve (9) that faces away from tank (2) is connected with the line (8) that connects the two throttles (6, 15).

6. Device according to claim 3, characterized in that the additional throttle (17) is located between the check valve (7) and the connection of the valve array (5) on the cylinder side.

7. Device according to claim 6, characterized in that a pressure-limiting valve (16) is connected to the line (18) that connects the additional throttle (17) with the check valve (7).

8. Device according to claim 1, characterized in that a pressure-limiting valve (14) is connected on the side of the first throttle (6) that faces away from pump (1).

* * * * *